US009359185B2

(12) United States Patent
Galland

(10) Patent No.: US 9,359,185 B2
(45) Date of Patent: Jun. 7, 2016

(54) DEVICE FOR CONNECTING A STORAGE VAT TO A FEED AND PROCESS FOR MANAGING SUCH CONNECTION

(75) Inventor: Régis Galland, Dinar (FR)

(73) Assignee: HYPRED, Dinard (FR)

( * ) Notice: Subject to any disclaimer, the term of this patent is extended or adjusted under 35 U.S.C. 154(b) by 300 days.

(21) Appl. No.: 13/344,847

(22) Filed: Jan. 6, 2012

(65) Prior Publication Data

US 2012/0222772 A1 Sep. 6, 2012

(30) Foreign Application Priority Data

Jan. 5, 2011 (FR) ..... 11 50063

(51) Int. Cl.
*B67D 7/34* (2010.01)
*B67D 7/78* (2010.01)

(52) U.S. Cl.
CPC . *B67D 7/342* (2013.01); *B67D 7/78* (2013.01)

(58) Field of Classification Search
CPC ..... B67D 7/34; B67D 7/342; B67D 7/78; B67D 7/02; B67D 7/0288; B67D 7/0294; G01N 1/2035
USPC ..... 141/83, 94–96, 196; 73/863.61
See application file for complete search history.

(56) References Cited

U.S. PATENT DOCUMENTS 3,681,997 A * 8/1972 Allen et al. ..... 73/863.61
4,475,665 A * 10/1984 Norton ..... 222/14
5,148,945 A * 9/1992 Geatz ..... 222/1
5,197,340 A * 3/1993 Jones ..... 73/864.35
5,273,085 A * 12/1993 Edwards et al. ..... 141/83
5,342,580 A * 8/1994 Brenner ..... 422/92
5,417,346 A * 5/1995 Ferri et al. ..... 222/61
5,490,611 A * 2/1996 Bernosky et al. ..... 222/1
5,525,298 A * 6/1996 Anami ..... 422/63
5,607,002 A * 3/1997 Siegele et al. ..... 141/198
5,722,469 A * 3/1998 Tuminaro ..... 141/94
5,821,406 A * 10/1998 Ridgeway et al. ..... 73/53.05
5,823,670 A * 10/1998 Rushing et al. ..... 366/152.1
5,922,969 A * 7/1999 Haar ..... 73/861.02
5,979,705 A * 11/1999 Kaehler et al. ..... 222/71
6,098,843 A * 8/2000 Soberanis et al. ..... 222/53
6,120,175 A * 9/2000 Tewell ..... 366/140
6,267,132 B1 * 7/2001 Guarneri ..... 137/14
6,346,198 B1 * 2/2002 Watson et al. ..... 210/739

(Continued)

FOREIGN PATENT DOCUMENTS

GB 2401976 11/2004
WO 9820342 5/1998

*Primary Examiner* — Timothy L Maust
(74) *Attorney, Agent, or Firm* — Morris & Kamlay LLP

(57) ABSTRACT

The device comprises a connecting pipe (18) having an inlet (18A) capable to be connected to the feed and an outlet (18B) capable to be connected to the storage vat (10), as well as a retaining chamber (20) which branches off from the connecting pipe (18) and which is equipped with a sampling valve (24). The connecting pipe comprises a charging valve (22), located between the retaining chamber and the outlet of the connecting pipe. After the product originating from the feed has been conveyed to the retaining chamber (20), and a sample of the product mixture present in the retaining chamber (20) has been taken to ascertain information relative to the nature of this mixture, and if the ascertained information corresponds to expected information, a charging valve (22) is opened to have the outlet of the connecting pipe (18) communicate with the vat (10).

22 Claims, 3 Drawing Sheets

(56) References Cited

U.S. PATENT DOCUMENTS

| | | | | |
|---|---|---|---|---|
| 6,457,494 | B1 * | 10/2002 | Gregg et al. | 141/4 |
| 6,592,827 | B1 * | 7/2003 | Zilker et al. | 422/119 |
| 6,604,555 | B2 * | 8/2003 | Blatt et al. | 141/21 |
| 6,637,475 | B2 * | 10/2003 | Noah et al. | 141/231 |
| 6,679,302 | B1 * | 1/2004 | Mattingly et al. | 141/104 |
| 6,945,288 | B1 | 9/2005 | Brakefield et al. | |
| 6,957,749 | B2 * | 10/2005 | Achkire et al. | 222/3 |
| 7,121,156 | B2 * | 10/2006 | Anschutz et al. | 73/863.61 |
| 7,334,708 | B2 * | 2/2008 | Xu et al. | 222/190 |
| 7,874,221 | B1 * | 1/2011 | Mayeaux | 73/863.83 |
| 8,037,894 | B1 * | 10/2011 | Kelekar et al. | 137/12 |
| 8,192,510 | B2 * | 6/2012 | Mattingly et al. | 44/451 |
| 8,196,904 | B2 * | 6/2012 | Boehm | 261/76 |
| 8,261,780 | B2 * | 9/2012 | Thomas et al. | 141/9 |
| 8,342,043 | B2 * | 1/2013 | Stevens et al. | 73/863.23 |
| 8,365,779 | B2 * | 2/2013 | Nakagawa et al. | 141/39 |
| 8,499,979 | B2 * | 8/2013 | Sand | 222/173 |
| 8,580,121 | B2 * | 11/2013 | Ladron de Guevara et al. | 210/709 |
| 8,602,069 | B2 * | 12/2013 | Popa et al. | 141/83 |
| 2002/0166391 | A1 * | 11/2002 | Khan et al. | 73/863.61 |
| 2009/0315729 | A1 | 12/2009 | Inhoffer | |
| 2010/0024915 | A1 | 2/2010 | Thomas et al. | |
| 2010/0170350 | A1 | 7/2010 | Stevens et al. | |
| 2013/0202988 | A1 * | 8/2013 | Wang et al. | 429/513 |

* cited by examiner

DEVICE FOR CONNECTING A STORAGE VAT TO A FEED AND PROCESS FOR MANAGING SUCH CONNECTION

CROSS-REFERENCE TO RELATED APPLICATION

This application is a Paris Convention foreign filing of French Appl. No. 1150063, filed on Jan. 5, 2011, which is incorporated by reference in its entirety.

The present invention relates to a device for connecting a storage vat of liquid or gaseous product to a feed, comprising a connecting pipe having an inlet capable of being connected to the feed and an outlet designed to be connected to the vat.

More particularly, this is a device which serves to the unloading of a chemical product, that is, decanting this product from a transport cistern to the storage vat. In this case, the feed is an outlet conduit of the cistern. For the unloading, also called charging, this feed is connected to the inlet of the connecting pipe, the outlet of which is connected to the vat, the connecting device remaining in place with its outlet connected to the vat.

The connection has to be operated so as to ensure that the product originating from the feed and feeding the vat is definitely the relevant product.

This is particularly important with respect to the unloading of a chemical product. In fact, if the transplanted product is not the preferred product, it can react with the product contained in the vat, whereby this reaction could be dangerous and cause phenomena such as discharge of toxic steam, discharge of heat, or even an explosion.

To limit these risks, safety barriers can be put in place, which confine the effects of such a reaction within a determined perimeter. Such confinement is evidently not totally satisfactory, in that it deals with the effects of inconvenient mixing, but does not prevent such inconvenient mixing. In any case, in some situations, such as a substantial reaction causing a toxic cloud, confinement is not possible.

To avoid such a substantial reaction, it is known to commence unloading by a preliminary test phase during which just a small quantity of product originating from the feed is poured out into the vat. Because of sensors fitted in the vat, the emergence of a possible chemical reaction is then detected before unloading is continued.

These precautions make it easier to confine the effects of unwanted mixing of products in the vat. However, they fail to avoid such unwanted mixing. On one hand, if the inconveniently mixed products are only slightly reactive, the sensors present in the vat do not necessarily detect the error on completion of the test phase such that the risk of the vat being filled by the unwanted product has not been eliminated. Also, these precautions can detect a feed error only once the unwanted product has entered the vat, thus contaminating the entire contents. As a consequence, the vat must be emptied and washed, and its contents are lost.

WO 98/20342 and GB 2 401 976 relate to the feed of the tank of a vehicle from a fixed tank. Sensors close off a stop valve if parameters detected by these sensors and compared in a processor do not correspond. In the same context, US 2009/315729 compares data relative to the fluid before being supplied and to the fluid present in the tank of origin.

These devices are delicate to operate and are not entirely reliable, to the extent where they do not confine the fluid used to detect the related parameters, and optionally introduced in error.

U.S. Pat. No. 5,722,469 also relates to the feed of the tank of a vehicle from a fixed tank. To avoid loading bad fluid, the device is equipped with a barcode reader and a comparator. This device does not avoid the risks of unwanted mixing, especially in the case where the barcode would be erroneous.

The aim of the present invention is to rectify these drawbacks by proposing a connecting device capable of avoiding feed from the storage vat to an unwanted product or, at the very least, limiting the risks of such a feed.

This goal is attained due to the fact that the connecting device according to the invention comprises a retaining chamber which branches off from the connecting pipe and which is equipped with a sampling valve, and that the connecting pipe comprises a charging valve located between the retaining chamber and the outlet of the connecting pipe.

Because of these arrangements, after the feed has been connected to the inlet of the connecting pipe, a small quantity of product originating from the feed can be allowed to reach the retaining chamber, while the charging valve is closed such that this product does not enter the vat.

The product contained in the retaining chamber can be sampled and its nature verified, in particular by chemical analysis and/or by comparison with a sample of the product previously contained in the vat, which has been kept aside.

Also, because the retaining chamber branches off from the connecting pipe, a small quantity of the product contained in the vat can be left in this chamber, which will have penetrated this retaining chamber during previous unloading, that is, during previous charging of the vat. In this case, if the product originating from the feed is not good, a reaction could occur with the product previously contained in the retaining chamber. To the extent where this chamber by definition has a small volume relative to that of the storage vat, it is easy to ensure that the quantity of product supplied is comparable to the quantity of product previously present in the retaining chamber. Therefore, the product supplied is not diluted in a substantial quantity of the product of the vat, such that, if a chemical reaction does occur, this reaction can easily be detected. Also, if the product originating from the feed is not good, only the small volume of product contained in the retaining chamber is polluted, whereas the content of the vat remains pure. Therefore, only the retaining chamber need be emptied.

Therefore, the charging valve will be controlled to permit charging only when it is sure that the product for which charging is contemplated, by means of the feed connected to the connecting pipe, is definitely the preferred product.

Advantageously, the device according to the invention comprises a control unit capable of generating an opening control signal of the charging valve on the basis of information relative to the nature of the collected product in the retaining chamber.

The information relative to the nature of the collected product can be its chemical composition, obtained after analysis, or else a physico-chemical parameter, for example obtained by physico-chemical analysis such as spectrography. It can also result from comparison between the collected product and a reference product, in particular the product previously contained in the vat. The signal can be generated automatically by the control unit. For example, the control unit can be equipped with a microprocessor or cooperate with a microprocessor, capable of making a comparison between the information relative to the nature of the collected product in the retaining chamber and expected information, for example, information relative to the nature of the product previously contained in the storage vat, stored in a storage zone of the microprocessor. The same control unit can manage several connection devices according to the invention, in which case the microprocessor can search for relevant information in a database containing information relative to the nature of products stored in different storage vats, associated with identification of these vats.

Advantageously, the retaining chamber is connected to the connecting pipe by a branch off element such as a branch off valve or a branch off pump, said element being capable of being activated to connect the retaining chamber to the connecting pipe.

This branch off element can be activated (that is, the branch off valve can be open or the branch off pump can be started up) at the start of charging to allow the retaining chamber to be fed with product originating from the feed connected to the inlet of the connecting pipe. If charging is permitted, the branch off element can be deactivated (closing of the branch off valve or stopping of the branch off pump) at the start or during charging, to prevent the charged product from transmitting via the retaining chamber or the link to this chamber causing turbulence in the flow of product poured out into the vat. The branch off element can also be activated momentarily during charging to feed the retaining chamber with charged product and accordingly enable a quantity of product present in the storage vat, which will be used for tests prior to enabling of subsequent charging, to be kept in this chamber.

Advantageously, the device comprises means for controlling the branch off element as a function of the volume of liquid or gas present in the retaining chamber.

For example, during tests prior to charging, the branch off valve can be opened to allow a preferred quantity of product coming from the feed to enter the retaining chamber, then be closed automatically when this quantity is attained. Similarly, after removal, in the retaining chamber, of the product used for charging-enabling tests, this branch off valve can be reopened during charging to pour out into the retaining chamber a preferred quantity of charged product, which will remain in this chamber to serve as test product used to authorise subsequent charging.

Advantageously, the device comprises means for controlling the sampling valve so as to collect a determined volume in the retaining chamber.

This allows tests to be conducted prior to the enabling of the charging on this determined volume of product.

Advantageously, the inlet of the connecting pipe is equipped with a lock, and the control unit is capable of controlling unlocking of the lock to enable connection of the feed with said inlet, on the basis of information relative to the nature of the product present in the feed.

This is an initial security which can prevent clearly incorrect connections. For example, information relative to the nature of the product present in the feed is entered by the supplier undertaking the charging on the basis of data it has, relative to the product contained in the cistern, the outlet of which constitutes the feed. This information can be entered manually or semi-automatically, for example by optical reading of a code such as a barcode relative to the product contained in the cistern. The information relative to the nature of the product present in the feed can also result from chemical or physico-chemical analysis of this product.

Advantageously, while the charging valve is in the closed state, the control unit is capable of successively sending an opening control signal of the sampling valve, a closing control signal of the sampling valve, and an opening control signal of the charging valve, ascertained from information relative to the nature of the collected product in the retaining chamber.

As it will be evident hereinbelow, this control sequence is advantageous to ensure the safety of the connection, in light of avoiding unwanted charging.

Advantageously, the control unit is also capable of controlling activation of the branch off element while the charging valve is in the closed state.

The invention also relates to a process for managing the connection of a storage vat of liquid or gaseous product to a feed, in which the inlet of a connecting pipe, whereof the outlet is connected to the storage vat, is connected to the feed.

As pointed out earlier, in particular when the connection is made to enable the unloading of a chemical product in the storage vat, it is necessary to ensure that the product originating from the feed and feeding the vat is definitely the preferred product.

The aim of the invention is to propose a connection process which prevents a feed of the storage vat with unwanted product or, at the very least, limits the risks of such a feed.

This aim is attained by the fact that the charging of the storage vat from the feed is enabled according to the following procedure:

- the product originating from the feed is conveyed from the connecting pipe in a retaining chamber,
- a sample of the product mixture present in the retaining chamber is taken to verify information relative to the nature of this mixture, and
- if the ascertained information corresponds to expected information, a charging valve is opened to have the outlet of the connecting pipe communicate with the vat.

This process verifies the nature of the product originating from the feed from the retaining chamber before introduction of this product to the storage vat and enables the charging of the vat only once this verification is completed.

Advantageously, the retaining chamber initially contains product contained in the vat.

All that is needed is to ensure, during previous charging, feeding of the retaining chamber with product used for this charging and to leave this product in this chamber until the next charging. This will easily detect the possible emergence of a chemical reaction between the product initially contained in the retaining chamber, which is the same as that which the vat contains, and the product intended for charging, which must normally also be the same as that contained in the vat. The fact that a chemical reaction occurs signifies that the product intended for charging is not good. In this case, information relative to the nature of the collected sample can be the simple fact that this sample produces discharge of heat or steam, which is a sign that a chemical reaction is underway. Of course, if no chemical reaction is detected, it would still be preferable to complete this information by chemical or physico-chemical analysis or by comparison with a reference product referring to one or more given parameters.

Advantageously, if the ascertained information does not correspond to the expected information, emptying of the retaining chamber is carried out.

Advantageously, the feed is connected to the inlet of the connecting pipe according to the following procedure:

- information relative to the nature of the product present in the feed is ascertained,
- this information is compared to expected information, and
- the feed is connected to the inlet of the connecting pipe if the ascertained information corresponds to the expected information.

This constitutes a previous step of the process of the invention limiting the risks of error by preventing clearly incorrect connections, as has been pointed out in relation to the device of the invention.

The invention will be better understood and its advantages will emerge more clearly from the following detailed description of embodiments illustrated by way of non-limiting examples. The description refers to the attached diagrams in which.

Figure 1:
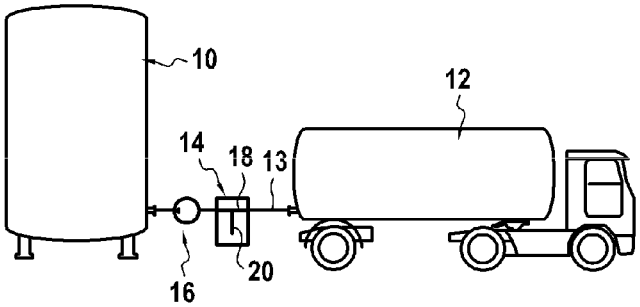
FIG. 1 shows a storage vat to which a charging cistern is connected via a connecting device.

FIG. 1 shows a storage vat 10 designed to contain a liquid or gaseous product, in particular a chemical reagent. This vat must be recharged regularly. In this case, FIG. 1 shows the situation during charging, the cistern 12 of a truck being connected to the storage vat via a connecting device 14. In terms of the present patent application, the flexible outlet conduit 13 of the cistern is the feed of the vat.

The vat 10 is filled by means of a pump 16 which, in this case, is placed downstream of the device 14. The connecting device could also function with a pump which would be placed upstream of this device, right at the cistern outlet.

The connecting device 14 comprises a connecting pipe 18 which is connected, at the inlet, to the cistern 12 via the flexible connecting hose 13, and, at the outlet, to the vat 10. This device also comprises a retaining chamber 20 which is branched off from the connecting pipe 18.

Figure 2:
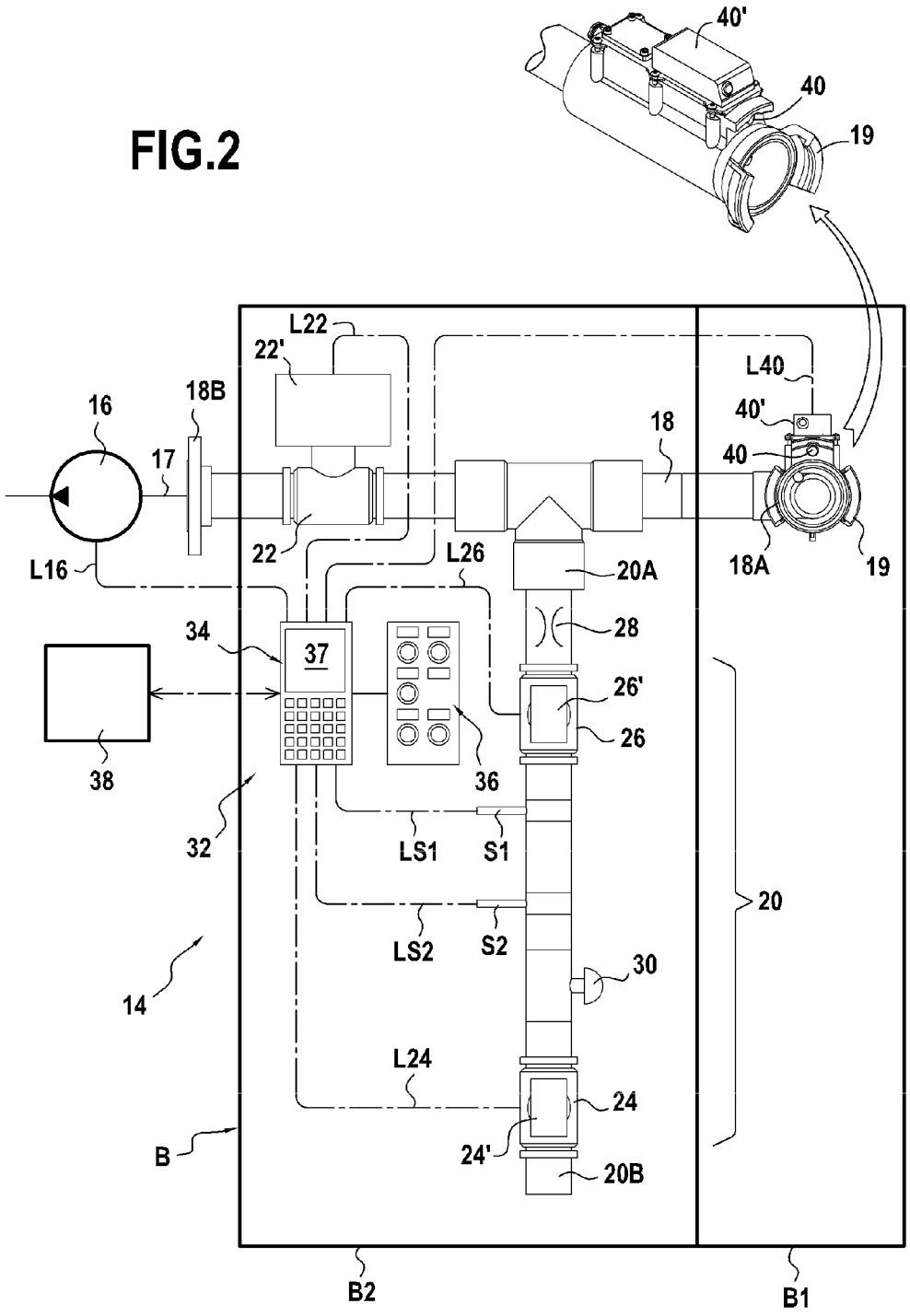
FIG. 2 shows the connecting device according to a first embodiment.

The structure of the connecting device will be better understood in reference to FIG. 2 which illustrates a first embodiment.

This figure shows the connecting pipe 18, with its inlet 18A by which it can be connected to the feed 13 and its outlet 18B connected to the storage vat 10.

Once in place, the connecting device 14 is stationary. Therefore, the outlet 18B of the connecting pipe 18 can be connected permanently to the vat 10 for example by a conduit 17 on which the pump 16 is placed, whereas its inlet 18A remains stationary so it can be connected to a feed cistern for the charging (unloading) of the vat 10.

In FIG. 2, the retaining chamber 20 takes the form of a section of dummy conduit whereof one end 20A is connected to the connecting pipe 18, between its inlet 18A and its outlet 18B, and whereof the opposite end 20B is closed. Therefore, the connecting pipe 18 and the retaining chamber 20 together form a T.

Between its outlet 18B and its connection with the retaining chamber at the end 20A of the latter, the connecting pipe 18 is equipped with a charging valve 22. For its part, the retaining chamber 20 is equipped with a sampling valve 24, which is near the closed end 20B of this chamber. From its open end 20A, the retaining chamber 20 is equipped with a branch off valve 26. It is understood that when this branch off valve 26 is open, the retaining chamber 20 communicates with the connecting pipe 18, whereas it is isolated when the valve 26 is closed. It is also a choice to connect the retaining chamber permanently to the connecting pipe, in which case the branch off valve is not necessarily present.

Advantageously, it is ensured that the feed of the retaining chamber 20 with product originating from the feed is at a low rate. This limits the risks of serious reactions and explosions, if the product originating from the feed is not good and reacts with the product already contained in the chamber 20. This low rate can be obtained by means of a restriction 28 by means of which the retaining chamber 20 is connected to the connecting pipe 18. This restriction can be placed towards the inlet 20A of the retaining chamber 20, as shown in FIG. 2. If the branch off valve 26 is present, the restriction 28 can also be placed downstream of this valve 26 or else can be integrated into this valve.

The retaining chamber 20 is also equipped with a decompression valve 30. The valve 30 opens automatically under the effect of an unwanted rise in pressure in the chamber 20, which might be due to the emergence of a chemical reaction in this chamber. The valve discharges the excess pressure to prevent deterioration of the retaining chamber and of the connecting pipe. It should be noted here that the volume of the retaining chamber is small such that the quantity of steam optionally released by the valve is too insignificant to be a source of pollution.

Figure 3:
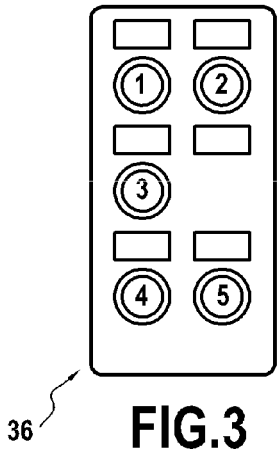
FIG. 3 shows a control panel for the charging of the vat.

The device also comprises a control unit 32 which, in this case, comprises an automatic machine 34 and a control interface unit 36. To carry out charging, the supplier communicates with the automatic machine via the control interface 36 which, as evident in FIG. 3, comprises for example a series of buttons 1 to 5; and via a communication module 37 (for example by display or sound) which can be integrated into the casing 36 or the automatic machine 34, as in the example shown.

The control unit 32 is related to the connecting device. FIG. 2 also shows that it can be placed in the same casing B as the set of elements of the device described above. However, it is advantageous for the control unit to communicate with a central control management unit 38, linked to a number of associated connection devices, and each of those, to a storage vat.

The control units 34 and 38 are electronic control units ("ECU") comprising microprocessors and storage zones.

Advantageously, at least one of the valves of the charging valve 22 and the sampling valve 24 is an electrovalve. Similarly, when present, the branch off valve 26 is advantageously an electrovalve.

It is preferable for at least the charging valve 22 to be able to be controlled by means of the control unit, without direct human intervention, and after verification of the fact that the product to feed the storage vat is the right product.

The sampling valve can be a manual valve, but the fact that it is an electrovalve helps secure the connection procedure. On one hand, this respects the opening sequence of the different valves, to be explained hereinbelow, the valve 22 normally only able to be open once sampling has been completed in the retaining chamber 20 by means of the sampling valve 24, to verify the nature of the product present in this chamber. Also, this makes it easy to collect a determined quantity of product in the retaining chamber.

In fact, the device advantageously comprises means for controlling the sampling valve 24 so as to collect a determined volume in the retaining chamber 20.

In this case, these means comprise two level sensors which equip the retaining chamber 20, in this case a high-level sensor S1 and a low-level sensor S2, the drawn volume being delimited between these two sensors. To automate the process, the sensors S1 and S2 are connected to the control unit 32 by data transmission lines LS1 and LS2, and the signals transmitted from there by these sensors control opening or closing of the valves 24 and 26.

In this case, the two valves 22 and 24, as well as the branch off valve 26, are electrovalves; and FIG. 2 illustrates their electrical controls, respectively designated by reference numerals 22', 24' and 26', these commands being respectively connected to the control unit 34 by control lines L22, L24 and L26.

It is also noted that the inlet 18A of the connecting pipe 18 is equipped with a lock 40 which must be unlocked to enable connecting of the feed (flexible hose 13 originating from the cistern) with the connecting pipe.

For example, the inlet 18A of the connecting pipe is in the form of a key connection mouth 19, access to this key being prevented by the lock 40 when it is locked. This lock acts as a lock and is preferably controlled electrically by an electric command 40', which is connected to the control unit 34 by a control line L40.

Also, the control unit 32 can control the activation of the pump 16 via a control line L16.

It should be noted that the different control lines and data transmission which have just been mentioned can be real lines or virtual lines, the transmission of commands and data able to be operated wirelessly.

The different elements of the connecting device are arranged in a casing B, remaining stationary in the immediate vicinity of the storage vat 10. It is in this advantageous respect that the inlet 18A of the connecting pipe 18 is in a first compartment B1 of this casing, whereas the current part of the connecting pipe 18, the retaining chamber 20, the different valves 22, 24, 26, the sensors S1 and S2 and, optionally, the control unit 32, are separate in this compartment B1, for example by being placed in the same second compartment B2 of the casing B.

As complement to or in place of the block 40 previously described, it can be that the first compartment B1 of the casing is normally closed by a wall locked by a lock which could be opened only after initial verification described hereinbelow has been completed. In particular, this lock could be controlled by the control unit 32. This is for example a lock of electromagnetic type.

Figure 4:
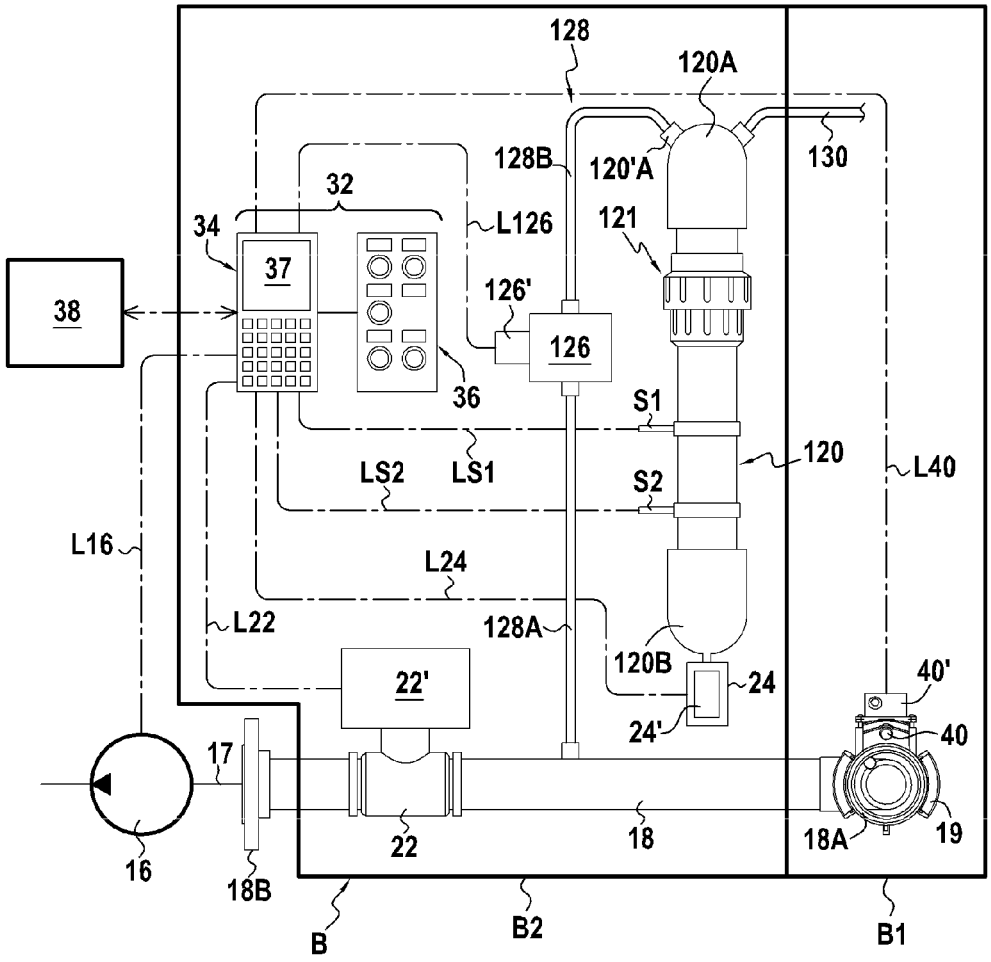
FIG. 4 is a view similar to FIG. 2, for a second embodiment.

FIG. 4, which illustrates another embodiment of the connecting device, is now described.

In this figure, the unchanged elements relative to FIG. 2 are designated by the same numeral references.

The second embodiment differs from the first one by the fact that the branch off valve 26 is replaced by a pump 126 which is placed on a branch off conduit 128. For example, as in the case shown, this branch off conduit can have an internal cross-section less than that of the connecting pipe 18, so as to form a restriction generating a loss of charge. In particular, the branch off conduit 128 can be formed by two sections of flexible hose, respectively an upstream section 128A connected by quick couplers to the connecting pipe 18 and to the pump 126, and a downstream section 128B connected by quick couplers to the pump 126 and to the inlet 120'A of the retaining chamber 120. The fact of making the branch off conduit in this form enables the retaining chamber 120 and the pump 126 to be positioned optimally, given the available space.

Another difference is the fact that the valve 30 of the first embodiment is here replaced by a vent situated at the upper end 120A of the retaining chamber 120. In the example shown, the vent is formed by a flexible hose 130 connected to the upper end 120A of the chamber 120 by a quick coupler.

For the rest, FIG. 4 shows the charging valve 22 located between the outlet of the connecting pipe and the connection of the latter to the branch off conduit 128, the sampling valve 24 located towards the lower end 120B of the retaining chamber 120, the high- and low-level sensors S1 and S2, and the lock 40 fitted on the inlet 18A of the connecting pipe 18.

There is also the control unit 32, with the automatic machine 34 and the control interface casing 36. This unit is connected to the sensors S1 and S2 by control lines LS1 and LS2, to the valves 22 and 24 by control lines L22 and L24, to the pumps 16 and 126 by control lines L16 and L126, and to the lock 40 by a control line L40.

The retention chambers 20 and 120 can be formed by sections of tube assembled by screw connections, as in FIG. 4 with the connection 121.

Figure 5:
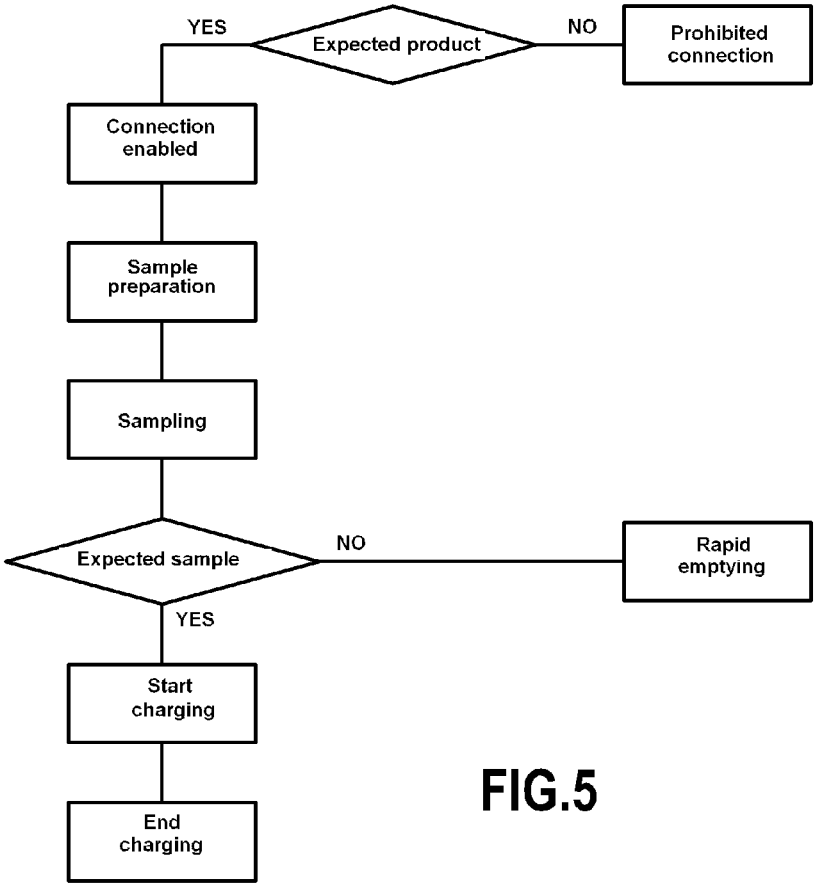
FIG. 5 is a block diagram showing the different phases of charging.

Also in reference to FIG. 5, the operation of the connecting device is now described.

In a first instance, the supplier brings the cistern near the storage vat, in a position enabling the connection of the feed with the connecting pipe 18.

Initial verification aimed at verifying that the product present in the cistern corresponds to the expected product is carried out. If this verification is positive, the connection can be made. For this, information relative to the nature of the product present in the feed is supplied to the control unit.

If this information corresponds to expected information, the control unit controls the action of the lock 40, therefore enabling connection. Information relative to the nature of the product present in the feed can be entered in any adapted form: entry by the supplier of a "product code" via the control interface 36, direct reading of a product code (for example of barcode type) by a sensor linked to this interface, or again, result of chemical or physicochemical analysis of the product contained in the cistern, after direct sampling on the cistern. This result can be transmitted to the central unit 38 which, is it corresponds to the preferred result, can transmit to the control unit 32 an enabling of connection control.

It should be noted that, being associated with several associated connection devices, each to a storage vat, the central unit 38 can manage a database comprising chemical or physicochemical parameters of the products contained in the different vats. Therefore, verification that the result of analysis corresponds to the preferred result can be done by comparison of the parameters obtained by this analysis with those contained by database, in association with the relevant vat.

Of course, if the information relative to the nature of the product present in the feed does not correspond to the expected information, connecting of the feed with the inlet of the connecting pipe is prohibited. This constitutes a first level of security. It can however happen that the information relative to the product present in the feed is incorrect (barcode or wrong entry) or that the information relative to the product present in the vat is wrong (error on the numbering of the vat or error on the database). The invention therefore enables a second level of security, implemented if connecting has been enabled.

In fact, in this situation, the next step is a sample preparation phase. For this, once the connection has been made, the product originating from the feed is conveyed to the retaining chamber 20 or 120, the charging valve 22 remaining closed.

For this, after connection is made, the supplier can actuate the "start" button 1 of the control panel 36, the communication module 37 being able, if needed, to invite it to verify that the outlet valve of the cistern is open.

At this stage, the sampling valve 24 is kept closed, but the branch off valve 26 or the pump 126, if they are present, are controlled to be activated (opening of the valve or starting of the pump).

Normally, the retaining chamber 20 or 120 initially contained the product contained in the storage vat, originating from the previous charging of this vat. For example, this product was present in a volume determined by the low-level sensor S2 and was protected from evaporation or degradation by the fact that the retaining chamber 20 or 120 was closed from this previous charging due to the closing of the branch off valve 26 or the stopping of the pump 126.

To prepare a sample, the valve 26 is open or the pump 126 is started, until the volume of product present in the retaining chamber 20 or 120 corresponds to the level of the high-level sensor S1. The sample consists therefore of a mixture of the product originating from the feed with the product initially present in the retaining chamber, in proportions and volumes determined by the sensors S1 and S2.

On completion of the preparation phase of the sample, the supplier can be invited by the communication module 37 to reclose the outlet valve of the cistern.

If the product originating from the feed is not the preferred product and is highly reactive with the product initially present in the retaining chamber 20 or 120, a chemical reaction can occur and easily be detected because it causes discharge of heat or discharge of gases boosting the pressure in the retaining chamber 20 or 120. In this respect, an explosion or degradation of the chamber 20 or 120 due to a sudden excess of pressure is prevented by the valve 30 or by the vent 130.

However, it can happen that an error on the product introduced to the retaining chamber is not as easily detectable. This is why the following step of the process consists of taking a sample of the mixture originating from the retaining chamber, by controlling the opening of the sampling valve 24 until the level of product present in the retaining chamber 20 or 120 has reached the low level detected by the sensor S2. For the supplier, this sampling can be carried out simply by actuating the "sampling" button 2 of the control panel 36, after having been invited to do so.

From this sample, information relative to the nature of this mixture is ascertained, in particular by chemical or physicochemical analysis.

The second verification is then carried out, which consists of ensuring that the drawn sample corresponds properly to the expected sample, for example by comparison between the information which has just been ascertained and stored information relative to the nature of the product contained in the storage vat 10.

If this verification is positive, charging can be started. The supplier can then actuate the "charging" button 3 of the control panel 36. In this case, the charging valve 22 can be opened and the pump 16 can be activated by the control unit 32. At the same time, the branch off valve 26 can remain closed or the branch off pump 126 can remain inactive, since the product remaining in the retaining chamber 20 or 120, which is at the low level, corresponds to the expected sample (that is, to the product which will be poured out into the vat 10), and could therefore serve as preparation of the next sample during subsequent charging.

The end of charging can be detected by any appropriate means, for example by automatic stop of the pump 16 when, with the cistern empty, this pump is no longer charged.

For security, when the end of charging is detected, the supplier can be invited by the communication module 37 to formalise the end of charging by actuating the "end of charging" button 4 of the control panel 36, this action putting all the valves in standby position for subsequent charging and causing the lock 40 to return to the locked position, as soon as the connection mouth 19 of the inlet 18A of the connecting conduit 18 will have been released.

If an error on the product which has been introduced to the retaining chamber is detected, charging is not enabled. It is also preferable to proceed with total, and preferably rapid, emptying of the retaining chamber.

For this, when the outlet valve of the cistern is closed (or the communication module 37 inviting the supplier to verify that this valve is closed), the supplier can activate the "rapid emptying" button 5 of the control panel 36, which causes the opening of the sampling valve 24 until the retaining chamber 20 or 120 is completely empty. Preferably, this also causes the opening of the branch off valve 26 or the starting of the pump 126 when they are present, to ensure that the product contained in the connecting pipe 18, upstream of this valve 26 or this pump 126, can also be evacuated.

When such emptying has been completed, the retaining chamber contains no more product which can serve to prepare a sample for subsequent charging.

In this case, this "retaining chamber empty" information can stored in the central unit 38 and/or in the control unit 32. This "retaining chamber empty" information can result from the fact that a third sensor (not shown) located in the lower part of the retaining chamber, under the sensor S2, detects no product in the retaining chamber.

If the retaining chamber is empty, the operator in charge of managing the stocks can be invited to conduct manual sampling of a sample test of product present in the vat so that during a subsequent attempt to charge the vat, this sample can be mixed with the product coming from a cistern connected to the connecting pipe.

During this next charging attempt, initial verification prior to the connection of the feed to the connecting pipe can be carried out normally. However, the second verification cannot be conducted. In this case, the product originating from the feed can be drawn normally from the retaining chamber by the sampling valve, but the charging valve can stay blocked as a special command, validating the collected product after its mixing in the laboratory with the sample test of collected product in the vat, has not been input.

The storage vat can have a volume of several cubic meters. By way of example, the maximum volume of the retaining chamber, determined by the high-level sensor S1, can be between 300 and 1000 ml, for example by being of the order of 500 ml, whereas its retention volume, determined by the low-level sensor S2, can be between 100 and 500 ml, for example by being of the order of 250 ml.

The invention claimed is:

1. A connection device of a storage vat for liquid or gaseous product to a feed, comprising a connecting pipe having an inlet capable of being connected to the feed and an outlet capable of being connected to the vat, and a retaining chamber, which branches off from the connecting pipe and which is equipped with a sampling valve, wherein the connecting pipe comprises a charging valve located between the retaining chamber and the outlet of the connecting pipe, the device further comprising a control unit capable of generating an opening control signal of the charging valve on the basis of information relative to the nature of the collected product in the retaining chamber, wherein the inlet of the connecting pipe is equipped with a lock and the control unit is capable of controlling the unlocking of the lock to enable the connection of the feed with said inlet, on the basis of information relative to the nature of the product present in the feed.

2. The device as claimed in claim 1, wherein the retaining chamber is connected to the connecting pipe by a branch off element, said element being capable of being activated to connect the retaining chamber to the connecting pipe.

3. The device as claimed in claim 2, comprising means for controlling the branch off element as a function of the volume of liquid or gas present in the retaining chamber.

4. The device as claimed in claim 1, wherein the retaining chamber is connected to the connecting pipe by a restriction generating a loss of charge.

5. The device as claimed in claim 1, comprising means for controlling the sampling valve so as to sample a determined volume in the retaining chamber.

6. The device as claimed in claim 1, wherein the retaining chamber is equipped with a decompression valve.

7. The device as claimed in claim 1, wherein the retaining chamber is equipped with a vent.

8. A connection device of a storage vat for liquid or gaseous product to a feed, comprising a connecting pipe having an inlet capable of being connected to the feed and an outlet capable of being connected to the vat, and a retaining chamber, which branches off from the connecting pipe and which is equipped with a sampling valve, wherein the connecting pipe comprises a charging valve located between the retaining chamber and the outlet of the connecting pipe, the device further comprising a control unit capable of generating an opening control signal of the charging valve on the basis of information relative to the nature of the collected product in the retaining chamber, wherein the control unit is capable, while the charging valve is in the closed state, of successively emitting an opening control signal of the sampling valve, a closing control signal of the sampling valve, and an opening control signal of the charging valve, based on information relative to the nature of the product sampled in the retaining chamber.

9. The device as claimed in claim 8, wherein the control unit is capable, while the charging valve is in the closed state, of successively emitting an opening control signal of the sampling valve, a closing control signal of the sampling valve, and an opening control signal of the charging valve, based on information relative to the nature of the product sampled in the retaining chamber.

10. The device as claimed in claim 3, wherein the control unit is also capable to control the activation of the branch off element while the charging valve is in the closed state.

11. The device as claimed in claim 1, wherein at least one of the valves of the charging valve and the sampling valve is an electrovalve.

12. The device as claimed in claim 3, wherein the branch off element comprises a branch off valve or a branch off pump.

13. A process for managing the connection of a storage vat for liquid or gaseous product to a feed, in which the inlet of a connecting pipe is connected to the feed whereof the outlet is connected to the storage vat, wherein charging of the storage vat from the feed is enabled according to the following procedure:

the product originating from the feed is conveyed from the connecting pipe to a retaining chamber, a sample of the product mixture present in the retaining chamber is taken to ascertain information relative to the nature of this mixture, and if the ascertained information corresponds to expected information, a charging valve is opened to have the outlet of the connecting pipe communicate with the vat.

14. The process as claimed in claim 13, wherein the retaining chamber initially contains the product contained in the vat.

15. The process as claimed in claim 13, wherein, if the ascertained information does not correspond to the expected information, the emptying of the retaining chamber is undertaken.

16. The process as claimed in claim 13, wherein the feed is connected to the inlet of the connecting pipe according to the following procedure:

information relative to the nature of the product present in the feed is ascertained, this information is compared to expected information, and the feed is connected to the inlet of the connecting pipe if the ascertained information corresponds to the expected information.

17. The device as claimed in claim 8, wherein the inlet of the connecting pipe is equipped with a lock and in that the control unit is capable of controlling the unlocking of the lock to enable the connection of the feed with said inlet, on the basis of information relative to the nature of the product present in the feed.

18. The device as claimed in claim 8, wherein the retaining chamber is connected to the connecting pipe by a branch off element, said element being capable of being activated to connect the retaining chamber to the connecting pipe.

19. The device as claimed in claim 8, wherein the retaining chamber is connected to the connecting pipe by a restriction generating a loss of charge.

20. The device as claimed in claim 8, wherein the retaining chamber is equipped with a decompression valve.

21. The device as claimed in claim 8, wherein the retaining chamber is equipped with a vent.

22. A connection device of a storage vat for liquid or gaseous product to a feed, comprising a connecting pipe having an inlet capable of being connected to the feed and an outlet capable of being connected to the vat, and a retaining chamber, which branches off from the connecting pipe, which is connected to the connecting pipe by a branch off element, said element being capable of being activated to connect the retaining chamber to the connecting pipe, and which is equipped with a sampling valve, wherein the connecting pipe comprises a charging valve located between the retaining chamber and the outlet of the connecting pipe, the device further comprising a control unit capable of generating an opening control signal of the charging valve on the basis of information relative to the nature of the collected product in the retaining chamber and of controlling the activation of the branch off element while the charging valve is in the closed state.

* * * * *